United States Patent [19]

Leupold

[11] Patent Number: 5,041,419

[45] Date of Patent: Aug. 20, 1991

[54] HIGH ENERGY PRODUCT RADIALLY ORIENTED TOROIDAL MAGNET AND METHOD OF MAKING

[75] Inventor: Herbert A. Leupold, Eatontown, N.J.

[73] Assignee: The United States of America as represented by the Secretary of the Army., Washington, D.C.

[21] Appl. No.: 517,016

[22] Filed: Apr. 30, 1990

Related U.S. Application Data

[63] Continuation-in-part of Ser. No. 379,033, Jul. 10, 1989, abandoned.

[51] Int. Cl.[5] ..... H01F 7/22

[52] U.S. Cl. ..... 505/1; 29/599; 29/607; 29/608; 264/24

[58] Field of Search ..... 505/1; 29/602.1, 607, 29/609, 608; 335/216, 301; 264/24

[56] References Cited

U.S. PATENT DOCUMENTS

| | | | |
|---|---|---|---|
| 2,188,091 | 1/1940 | Baermann, Jr. | 29/607 |
| 2,849,312 | 8/1958 | Peterman | 29/608 X |
| 4,205,430 | 6/1980 | Jaffe | 264/24 X |
| 4,457,851 | 7/1984 | Tabaru et al. | 264/24 X |

FOREIGN PATENT DOCUMENTS

| | | | |
|---|---|---|---|
| 07155706 | 9/1982 | Japan | 29/602.1 |

*Primary Examiner*—Joseph M. Gorski

*Attorney, Agent, or Firm*—Michael Zelenka; Roy E. Gordon

[57] ABSTRACT

An improved high energy product radially oriented toroidal magnet is made from an iron cylinder toroid by a method including the steps of:

(A) sandwiching the iron cylinder toroid between two disc toroids of a superconductive material at a temperature above the transition temperature of the superconductive material at which temperature the superconductive material does not have superconducting properties and therefor cannot affect the magnetic state of the iron toroid, (B) aligning the iron radially with a small applied field so that flux lines go through the toroidal magnet in a radial direction and in response to which the magnetic dipoles of the iron align themselves with those flux lines, (C) cooling the superconductive material to below the transition temperature of the superconductive material thereby trapping magnetic flux in the iron cylinder toroid, and (D) removing the small applied field from the iron cylinder toroid that does not affect the radial magnetization of the iron as the radial magnetization of the iron is now sustained by the superconducting toroid.

2 Claims, 1 Drawing Sheet

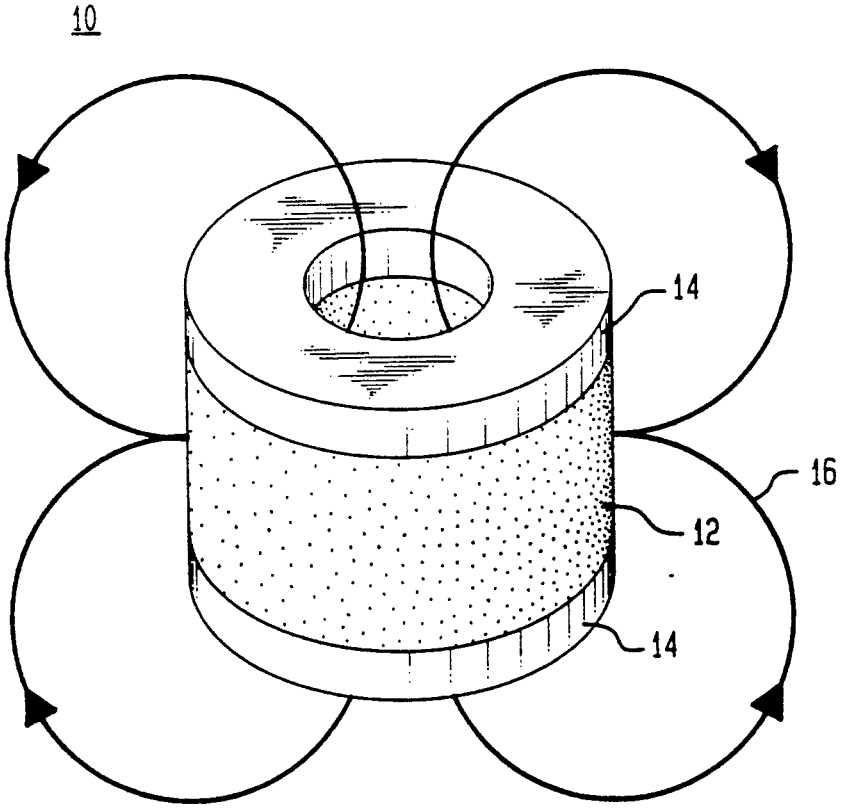
10
14
16
12
14

HIGH ENERGY PRODUCT RADIALLY ORIENTED TOROIDAL MAGNET AND METHOD OF MAKING

The invention described herein may be manufactured, used, and licensed by or for the Government for governmental purposes without the payment to me of any royalty thereon.

This application is a continuation in part application of U.S. patent application Ser. No. 379,033 filed July 10, 1989 by Herbert A. Leupold for "High Energy Product Radially Oriented Toroidal Magnet and Method of Making" and assigned to a common assignee now abandoned.

This invention relates in general to an improved high energy product radially oriented toroidal magnet and to its method of making, and in particular to such a magnet made from an iron cylinder toroid.

BACKGROUND OF THE INVENTION

It has been very difficult to get good magnetic alignment in radially oriented toroids, especially in those toroids with small toroidal holes. The reason is that in those cases, it is difficult to get sufficient flux into the hole to provide for sufficient aligning fields to orient the powder of high magnet material while it is being pressed prior to sintering.

SUMMARY OF THE INVENTION

The general object of this invention is to provide an improved high energy product radially oriented toroidal magnet. A further object of the invention is to provide a method of making such a magnet from an iron cylinder toroid. A still further object of the invention is to provide radially oriented toroidal magnets with energy products of 100MGOe as compared with the maximum of 15MGOe obtainable today.

It has now been found that the aforementioned objects can be attained and an improved high energy product radially oriented toroidal magnet made from an iron cylinder toroid by a method including the steps of:

(A) sandwiching the iron cylinder toroid between two disc toroids of a superconductive material at a temperature above the transition temperature of the superconductive material, (B) aligning the iron radially with a small applied field, (C) cooling the superconductive material to below the transition temperature of the superconductive material thereby trapping magnetic flux in the iron cylinder toroid, and (D) removing the small applied field.

In the aforedescribed method, and particularly in clause (A) when the superconductive material is at a temperature above the transition temperature, the superconductive material does not have superconducting properties and therefor cannot affect the magnetic state of the iron toroid. When the superconductive material is at a temperature above its transition temperature, a small magnetic field is applied as in clause (B) so that the flux lines go through the annular ring of the magnet in a radial direction. In response to this field, the magnetic dipoles of the iron align themselves with those flux lines. When the superconductive material is then cooled to below its transition temperature, as in clause (C), the superconductive material becomes superconducting and can trap permanently any flux that threads the hole prior to the superconductive materials becoming superconducting. This also means that the iron must retain the magnetization that it had in the presence of the originally applied field as in clause (A) even after that field is removed as in clause (D) thereby resulting in a radially magnetized magnet of much higher energy product than is obtainable from any permanent magnet material.

In carrying out the method, a magnetizing jig can be used to apply the small field needed to orient the iron. The fixture and structure are then cooled to below the transition temperature of the superconductive material. The magnetizing jig is removed and the flux produced by the iron plus that due to the original magnetizing field remains trapped in the rings and an iron radial magnet of $B_R=20$ kG results, with roughly 4 times the energy product of the best materials available today. The method works best for toroid cylinders with annular thickness that are large compared to the toroid's inner radius as then the demagnetizing fields to be overcome by the applied fields are smaller.

DESCRIPTION OF THE DRAWING AND THE PREFERRED EMBODIMENT

The drawing shows an improved high energy product radially oriented toroidal magnet according to the method of the invention.

Referring to the drawing, an improved high energy product radially oriented toroid magnet 10, include an iron cylinder toroid, 12 sandwiched between two disc toroids of a superconductive material, 14 of the same inner and outer radius as that of the iron cylinder toroid, 12 at a temperature above the transition temperature of the superconductive material. The iron, in the iron cylinder toroid, 12 is aligned radially with a small applied field of several hundred to several thousand Gauss (not shown) and the superconductive material, 14 cooled to below its transition temperature thereby trapping magnetic flux, 16 in the iron cylinder toroid, 12. The small applied field is then removed.

As the superconductive material used in the method, one must use a high transition temperature material with sufficient strength to trap up to 6 tesla of flux density. Examples of such materials include $YBa_2Cu_3O_{7-y'}$, $Bi_2(Ca_1Sr)_3Ca_2O_{8+y'}$, and $Tl\ Ca_{1.5}\ BaCu_3O_{8.5-y}$ of which $YBa_2Cu_3O_{7-y}$ is preferred.

The superconductive disc toroids must also conserve flux trapped in their holes so that flux previously furnished by the iron and the small applied field can then be sustained by persistent currents generated in the superconductive disc toroid upon removal of the small applied field.

I wish it to be understood that I do not desire to be limited to the exact details of construction shown and described for obvious modifications will occur to a person skilled in the art.

What is claimed is:

1. Method of making a high energy product radially oriented toroidal magnet from an iron cylinder toroid, said method including the steps of:

(A) sandwiching an iron cylinder toroid between two disc toroids of a superconductive material at a first temperature above a transition temperature of the superconductive material, at which first temperature the superconductive material does not have superconducting properties and therefor cannot affect the magnetic state of the iron cylinder toroid, (B) aligning the iron radially by applying a small field of several hundred to several thousand gauss to the iron cylinder toroid, so that flux lines go through the iron cylinder toroid in a radial direction and magnetic dipoles of the iron align themselves with those flux lines, (C) cooling the superconductive material to below the transition temperature of the superconductive material, thereby making the disc toroids superconducting, and thereby trapping magnetic flux in the iron cylinder toroid, and (D) removing the small applied field from the iron cylinder toroid, whereby radial magnetization of the iron is not affected by removing the applied field, since the radial magnetization of the iron is now sustained by the superconducting toroids.

2. The method according to claim 1 wherein the superconductive material is $YBa_2Cu_3O_{7-y}$.

* * * * *